US009105988B2

(12) United States Patent
Chastain et al.

(10) Patent No.: US 9,105,988 B2
(45) Date of Patent: Aug. 11, 2015

(54) COAXIAL CABLE CONNECTOR WITH CONTINUITY BUS

(71) Applicant: PERFECTVISION MANUFACTURING, INC, Little Rock, AR (US)

(72) Inventors: Robert J. Chastain, Maumelle, AR (US); Glen David Shaw, Conway, AR (US); Charles D. Davidson, Jr., Little Rock, AR (US)

(73) Assignee: PerfectVision Manufacturing, Inc., Little Rock, AR (US)

( * ) Notice: Subject to any disclaimer, the term of this patent is extended or adjusted under 35 U.S.C. 154(b) by 6 days.

(21) Appl. No.: 14/245,919

(22) Filed: Apr. 4, 2014

(65) Prior Publication Data

US 2014/0335725 A1 Nov. 13, 2014

Related U.S. Application Data

(60) Provisional application No. 61/822,834, filed on May 13, 2013.

(51) Int. Cl.
*H01R 9/05* (2006.01)
*H01R 103/00* (2006.01)

(52) U.S. Cl.
CPC ..... *H01R 9/0512* (2013.01); *H01R 9/0521* (2013.01); *H01R 2103/00* (2013.01)

(58) Field of Classification Search
CPC ..... H01R 17/12; H01R 13/193
USPC ..... 439/578, 675, 352, 268
See application file for complete search history.

(56) References Cited

U.S. PATENT DOCUMENTS

| | | | | |
|---|---|---|---|---|
| 6,352,448 | B1 * | 3/2002 | Holliday et al. | 439/585 |
| 7,189,114 | B1 * | 3/2007 | Burris et al. | 439/578 |
| 7,311,554 | B1 * | 12/2007 | Jackson et al. | 439/584 |
| 7,892,024 | B1 | 2/2011 | Chen | |
| 2006/0246774 | A1 * | 11/2006 | Buck | 439/578 |
| 2007/0224880 | A1 * | 9/2007 | Wlos et al. | 439/578 |
| 2011/0230091 | A1 | 9/2011 | Krenceski et al. | |
| 2011/0306236 | A1 | 12/2011 | Addario et al. | |
| 2013/0102189 | A1 | 4/2013 | Montena | |

FOREIGN PATENT DOCUMENTS

JP 2010146836 A 7/2010

* cited by examiner

*Primary Examiner* — Phuongchi T Nguyen
(74) *Attorney, Agent, or Firm* — Ocean Law; Paul D. Chancellor

(57) ABSTRACT

A coaxial cable connector including a continuity bus extending a ground circuit between a coaxial cable outer conductor and a coaxial cable connector part such as a coaxial cable connector fastener.

21 Claims, 15 Drawing Sheets

FIG. 1D

100D

| PART | Path 1 | Path 2 | Path 3 |
|---|---|---|---|
| 1. Coaxial Cable Outer Conductor | X | X | X |
| 2. Continuity Bus | | | X |
| 3. Post | X | X | |
| 4. Fastener | X | | X |
| 5. Port | X | X | X |

COAXIAL CABLE CONNECTOR WITH CONTINUITY BUS

PRIORITY CLAIM AND INCORPORATION BY REFERENCE

This application claims the benefit of U.S. Provisional Application No. 61/822,834 filed May 13, 2013 and entitled COAXIAL CABLE CONNECTOR WITH CONTINUITY BUS which is incorporated herein in its entirety and for all purposes.

BACKGROUND OF THE INVENTION

Coaxial cable connectors are well-known in various applications including those of the satellite and cable television industry. Coaxial cable connectors including F-Type connectors used in consumer applications such as cable and satellite cable connectors are a source of service calls when service is interrupted by lost and/or intermittent coaxial cable connections typically involving a junction between a male F-type connector terminating a coaxial cable and a female F-type port located on related equipment.

FIELD OF INVENTION

This invention relates to the electromechanical arts. In particular, an electrical connector incorporates a center conductor and a ground conductor surrounding the center conductor.

DISCUSSION OF THE RELATED ART

Coaxial cable connectors include variants designed to improve electrical continuity under extenuating circumstances. These continuity improving connectors have generally utilized assemblies of bare electrical conductors in a multipart ground circuit interconnecting the outer conductor of a coaxial cable and the grounded casing of a female F-type port.

SUMMARY OF THE INVENTION

Embodiments of the continuity bus of the present invention provide an electrical ground path between a coaxial cable outer conductor and an electrically conducting fastener of the connector such that the connector ground circuit tends to be maintained during events including movement of the connector fastener relative to the connector body and failure to properly tighten the connector fastener to a female port.

The present invention provides a coaxial connector with a continuity bus. Embodiments provide a continuity bus embedded in a peripheral non-conductive connector body wall such as a cylindrical body wall.

In an embodiment, a coaxial cable connector comprises: a tubular body defining a cylindrical wall section made from an insulating material; the tubular body for receiving a prepared end of a coaxial cable with a central signal conductor spaced apart from an exposed ground conductor; a fastener incorporating an electrically conductive material, the fastener rotatably coupled to the tubular body; an elongated continuity bus having a first contact portion operable to electrically contact the exposed ground conductor and a second contact portion operable to rub the rotatable fastener; and, at least a portion of the continuity bus embedded in the wall section of the tubular body.

In another embodiment, the above connector's electrical contact between the fastener and the continuity bus second contact portion is maintained if the fastener is moved away from the body.

And in yet another embodiment, the above connector's electrical contact between the fastener and the continuity bus second contact portion is maintained if the fastener is moved toward the body.

BRIEF DESCRIPTION OF THE DRAWINGS

The present invention is described with reference to the accompanying figures. These figures, incorporated herein and forming part of the specification, illustrate the present invention and, together with the description, further serve to explain the principles of the invention and to enable a person skilled in the relevant art to make and use the invention.

FIG. 1D shows electrical grounding paths in tabular format.

DETAILED DESCRIPTION OF THE PREFERRED EMBODIMENTS

The disclosure provided in the following pages describes examples of some embodiments of the invention. The designs, figures, and descriptions are non-limiting examples of certain embodiments of the invention. For example, other embodiments of the disclosed device may or may not include the features described herein. Moreover, disclosed advantages and benefits may apply to only certain embodiments of the invention and should not be used to limit the disclosed inventions.

Figure 1A:
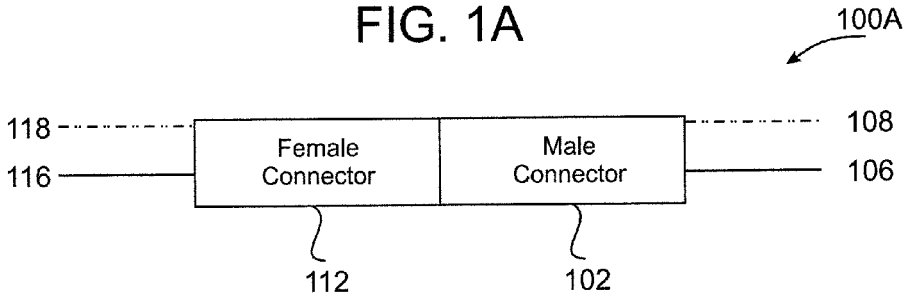
FIGS. 1A-C show coaxial cable connectors and mated coaxial cable connectors.

FIG. 1A shows a schematic of mated male 102 and female 112 coaxial cable connectors such as mated F-type connectors 100A. The mated connectors provide electrical continuity between respective central conductors 106, 116 and electrical continuity between respective outer conductors 108, 118. The outer conductors are commonly referred to as ground conductors.

Figure 1B:
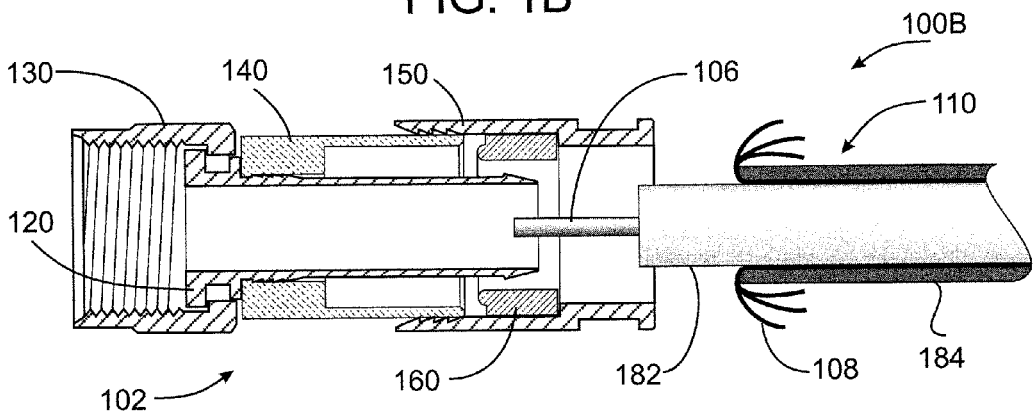

FIG. 1B shows an F-type male connector 102 before its attachment to a prepared end of a partially inserted coaxial cable 110 100B. The connector shown includes a fastener 130 coaxially arranged with a tubular body 140. The fastener is rotatable with respect to the tubular body. For example, embodiments include a post 120 rotatably coupling the fastener and the body. Further, some embodiments include a wedge part 160 movable with a rear shell 150 to fix the cable to the connector.

The coaxial cable 110 includes a dielectric 182 surrounding the central conductor. The outer conductor 108 surrounds the dielectric and an outer insulating jacket 184 envelops the dielectric and conductors.

Figure 1C:
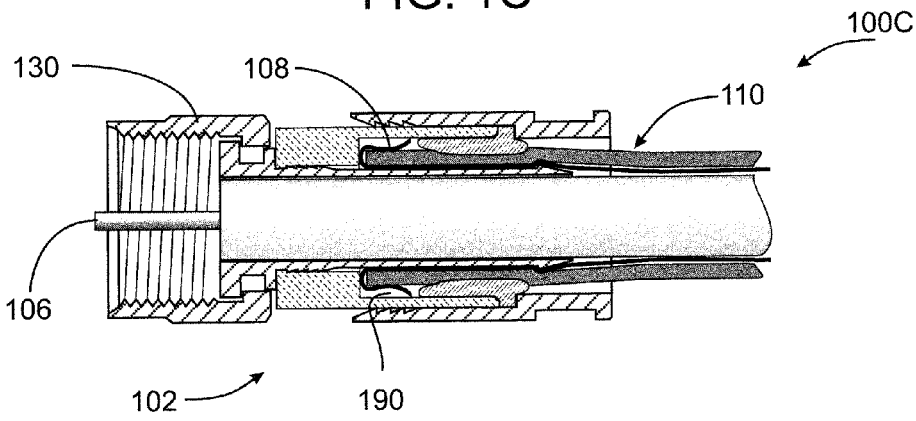

FIG. 1C shows an F-type male connector 102 after its attachment to the prepared end of the fully inserted coaxial cable 110 100C. As seen here, the outer conductor is positioned in an annular space 190 between the body 140 and the post 120, and the rear shell 150 is moved forward, pushing the wedge part 160 into an annular space between the coaxial cable and the body so as to fix the cable to the connector.

FIG. 1D shows three ground paths through the connector of FIG. 1C 100D. These ground paths do not rely on an electrically conductive body, a useful feature when the body is made from non-conducting materials such as non-conducting plastics.

Path 1 is a ground path between a coaxial cable outer conductor and a female port ground. See for example the coaxial cable outer conductor 108 and female port ground 118. As shown, the ground path passes through a post (e.g. post 120) and through a fastener (e.g. fastener 130).

Path 2 is a ground path between a coaxial cable outer conductor and a female port ground. See for example the coaxial cable outer conductor 108 and female port ground 118. As shown, the ground path passes through a post (e.g. post 120).

Path 3 is a ground path between a coaxial cable outer conductor and a female port ground. See for example the coaxial cable outer conductor 108 and female port ground 118. As shown, the ground path passes through a continuity bus (see below) and through a fastener (e.g. fastener 130).

Figure 2A:
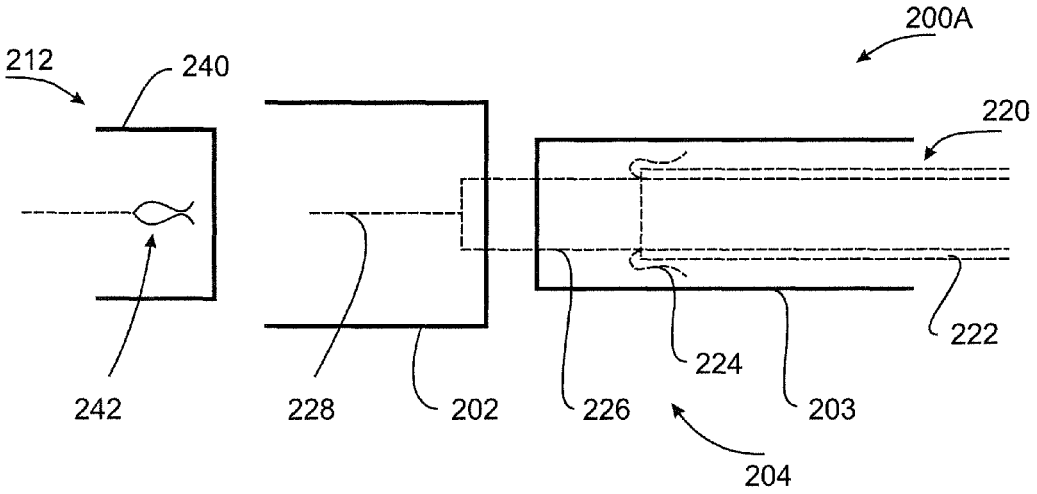
FIG. 2A shows a schematic diagram of a coaxial cable connector.

FIG. 2A shows a schematic of adjacent coaxial cable connectors 200A. A male coaxial connector such as an F-type connector 204 is adjacent to a female coaxial cable connector 212. As shown, the female coaxial connector includes a central signal contact 242 for contacting the center conductor 228 of a coaxial cable 220. The cable center conductor is surrounded by a dielectric 226 while an insulating jacket 222 covers the outer conductor 224.

As shown, the cable 220 is inserted through a male connector body 203. The body is made from a material that is not electrically conductive. The male connector includes a fastener 202 for engaging the female port such as the female connector ground 240 and, in various embodiments the fastener and the body are rotatably engaged, for example by a post (not shown).

Figure 2B:
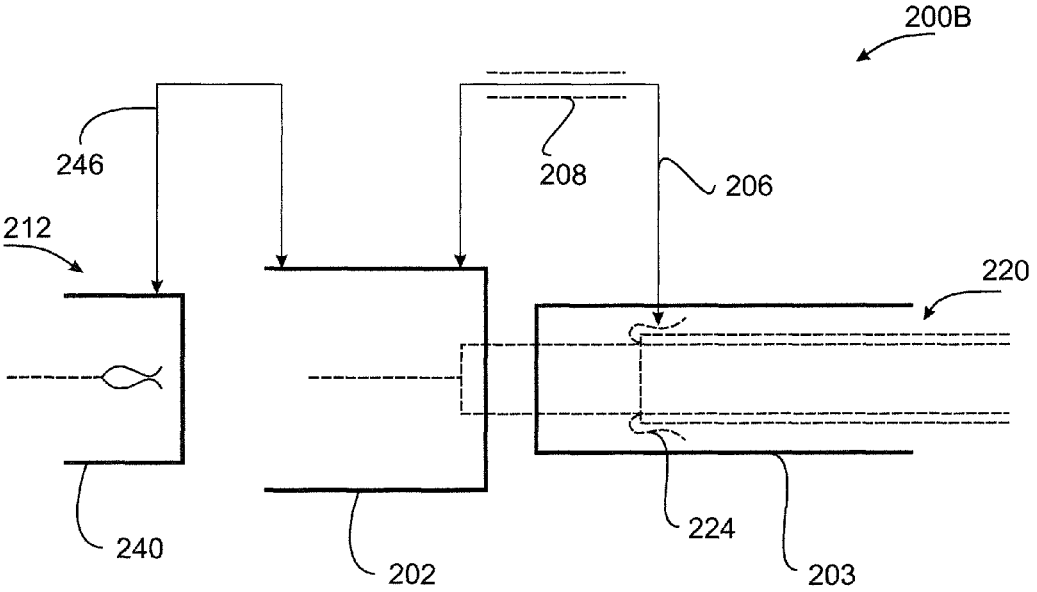
FIG. 2B shows a schematic diagram of a coaxial cable connector including a continuity bus.

FIG. 2B shows a schematic of a connector that incorporates a continuity bus 200B. A ground path between the coaxial cable 220 outer conductor 224 and the female connector 212 ground 240 is also indicated. In particular, a continuity bus 206 electrically interconnects the coaxial cable's exposed outer conductor 224 with the electrically conductive fastener 202 of the male connector.

In various embodiments, at least portion(s) of the continuity bus penetrate the connector body. For example, in various embodiments at least portion(s) of the continuity bus are immovably or slidably embedded in a wall forming the connector body as shown by a continuity bus insulated portion 208.

The ground path to the female connector ground 212 is completed 246 when the male connector fastener 202 engages a female port such as the female connector ground 240. Similar to the depiction of FIG. 1A, this ground path interconnects a ground at a male connector (e.g. male connector ground 108) with a ground at the female connector (e.g. female connector ground 118). And, similar to Path 3 of FIG. 1D, a ground path between a coaxial cable outer conductor and a female port ground via a continuity bus and a fastener is described.

Figure 3A:
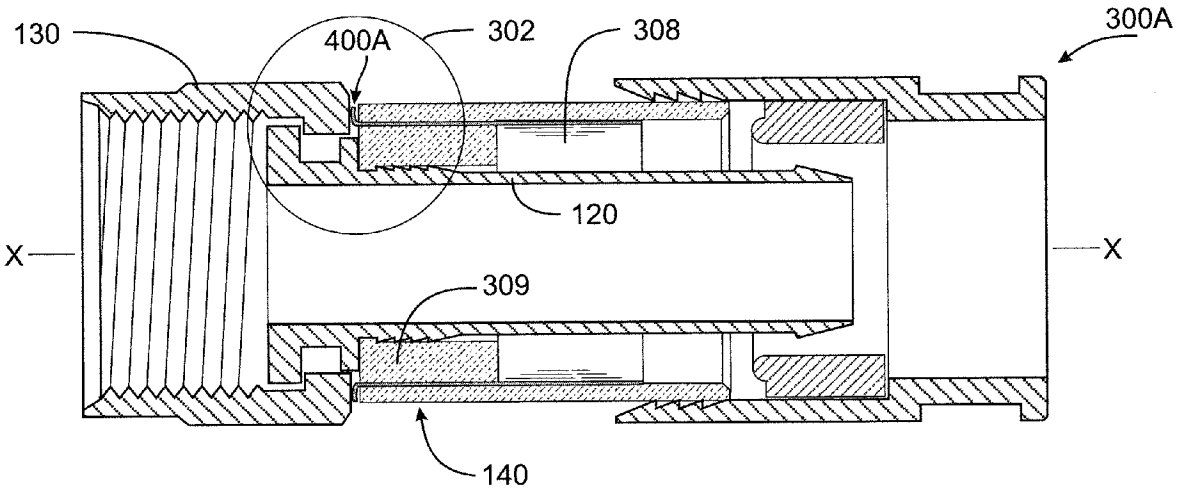
FIGS. 3A-3C show cross-sectional views of a coaxial cable connector with a continuity bus.

FIG. 3A shows a connector that incorporates a continuity bus 300A. Notably, here and elsewhere in applicant's disclosure, exemplary connectors of particular design are used to illustrate making and using the present invention and the continuity bus of the present invention. Such descriptions are not to be used to limit the applicability of the inventive ideas expressed herein. Rather, they should be understood to teach inventive concepts applicable to various connectors through use of the selected example(s).

The exemplary connector of FIG. 3A includes a post 120, a suitable fastener such as a nut engaging the post 130 and a body 140. These parts are coaxially arranged with the post extending between and into each of the fastener and the body. A coaxial cable annular receiving space 308 is formed between the body and the post such that when the prepared end of a coaxial cable is inserted into the connector body, the cable outer conductor 108 is received in this space.

Figure 3C:
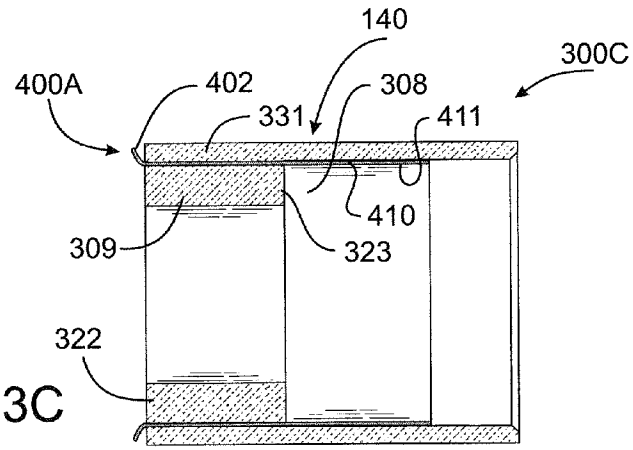
Figure 3B:
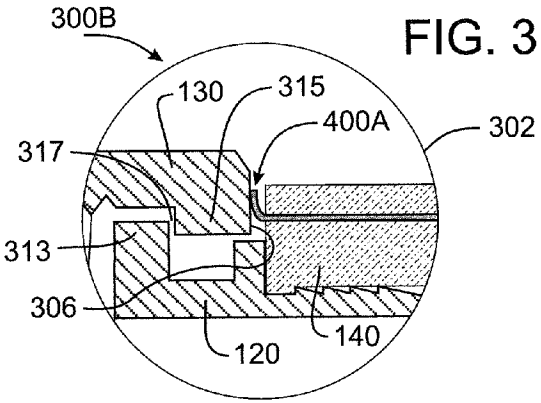

FIG. 3B shows an enlarged portion of the connector of FIG. 3B 300B. The enlarged portion 302 shows the fastener 130 to post 120 rotatable engagement and a body 140 to post attachment. In various embodiments, the fastener is coupled to the post via a post flange 313 that interengages an inwardly directed fastener rim 315. And, in various embodiments a body neck 309 surrounds and attaches to the post near the post flange.

FIG. 3C shows an enlarged view of the body of the connector of FIG. 3A 300C including a continuity bus 400A. As shown here, the continuity bus passes through a body wall or as shown through a portion of a cylindrical body wall 331 of the body 140. A portion of the continuity bus is fixedly embedded in the body wall. Notably, in some other embodiments discussed below, a continuity bus portion is movably embedded in a body wall.

Each of FIGS. 3A-3C shows the continuity bus 400A. Shown best in FIG. 3C, the continuity bus is located in the body wall 331 such that a continuity bus fastener contact 402 is exposed, at least in part, near one end of the bus and a continuity bus outer conductor contact 410 is exposed, at least in part, near an opposite end of the bus.

In various embodiments, the fastener contact 402 protrudes from a neck end of the body 322 and in some embodiments is turned away from the connector centerline x-x (forming an "L" like shape as shown). And, in some embodiments, the continuity bus outer conductor contact 410 protrudes near a neck internal face 323 into the outer conductor receiver annulus 308 such that a surface of the outer conductor contact 411 faces the connector centerline.

When a body 140 with an integral continuity bus 400A is assembled in a connector, embodiments of the present invention provide for contact and/or following contact between the fastener and the fastener contact. In the present example, a spring-like action of the fastener contact maintains following contact between the fastener and the continuity bus.

In particular, assembly of the connector presses the fastener contact against the fastener back face 306 such that the fastener contact is resiliently moved toward the body. This action tends to resist formation of a gap 317 between the post flange 313 and the fastener rim 315. In various embodiments, the fastener contact acts to press the fastener rim 315 against the post flange 313 such that actions that would open the gap 317 are resisted by resilient operation of the fastener contact.

Figure 4A:
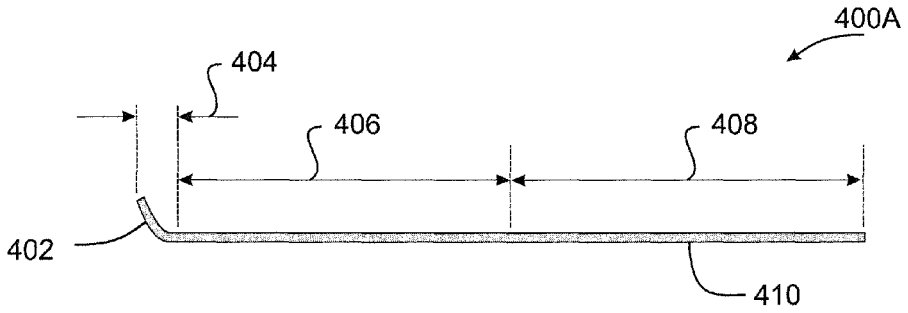
FIG. 4A shows a schematic view of a continuity bus.

FIGS. 4A-D show a first group of continuity bus embodiments 400A-D. In FIG. 4A, a continuity bus 400A includes a bus front projection 404, a rear projection 408 and a bus midsection 406 interconnecting the front and rear projections. The bus front projection includes the fastener contact 402 while the bus rear projection includes the outer conductor contact 410.

As shown in the embodiment above, the bus front projection 404 extends away from the body 140 and toward the fastener 130 and the fastener contact 402 is an end portion of the front bus projection. As shown in the embodiment above, the bus rear projection 408 extends within the body and the outer conductor contact 410 is an inwardly directed face of the bus rear projection. And, as shown in the embodiment above, the bus midsection 406 is embedded, at least in part, in the connector body periphery, for example in the connector body neck 309.

Continuity bus embodiments include busses formed from elongated wires, pins, and other suitable structures whether they have regular or irregular cross-sections. Continuity bus embodiments also include embodiments utilizing plural continuity bus parts such as use of multiple independent continuity bus pins. Other continuity bus embodiments include partial or complete figures of revolution such as circular sections. Yet other continuity bus embodiments combine bus portions that are figures of revolution, circular cross section for example, with portions that are not figures of revolution, fingers for example.

Figure 4B:
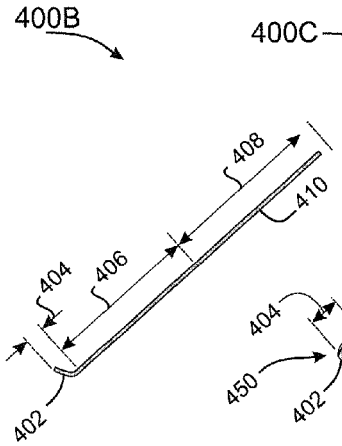
FIGS. 4B-4D show perspective views of continuity bus embodiments.

FIG. 4B shows an elongated continuity bus in a form such as a wire or a pin 400B. As above, the bus has front and rear projections 404, 408 interconnected by a bus midsection 406. Bus terminations are a front contact 402 and an outer conductor contact 410.

Figure 4C:
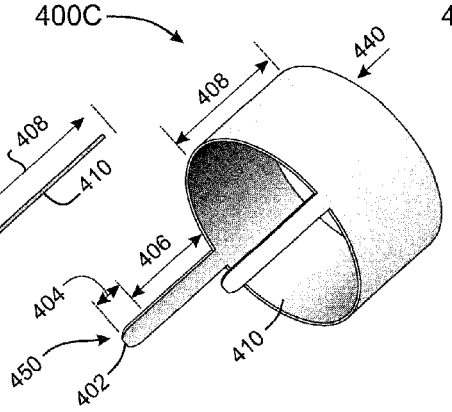

FIG. 4C shows a continuity bus including a generally circular section 400C. As shown, the generally circular section 440 forms the bus rear projection 408 and an inside surface of the circular section forms the outer conductor contact 410. Two fingers 450 extend from the circular section. Each finger includes at least a part of a bus midsection 406 and a bus front projection 404 terminating in a fastener contact 402.

Figure 4D:
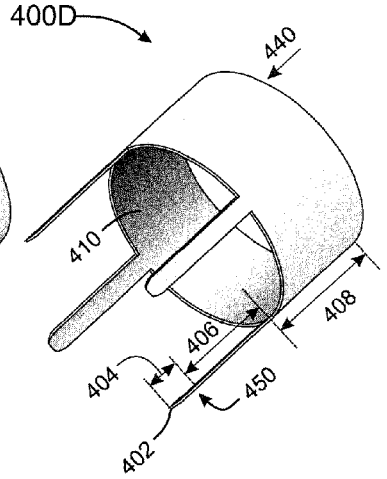

FIG. 4D shows another continuity bus including a generally circular section 400D. As shown, the generally circular section 440 forms the bus rear projection 408 and an inside surface of the circular section forms the outer conductor contact 410. Here, four fingers 450 extend from the circular section. Each finger includes a bus midsection 406 and a bus front projection 404 terminating in a fastener contact 402. Although there is generally a preference for a symmetrical arrangement of multiple fingers about a circular periphery, skilled artisans will recognize suitable arrangements provide one or more fingers.

As suggested by the above, various embodiments provide a fastener contact for rubbing against a portion of the fastener 130. In FIGS. 3A-C, embodiments provide a turned end of the continuity bus for rubbing against what is shown as a generally flat fastener back face 306. Other embodiments provide for alternative engagements between the fastener and the continuity bus. For example, the fastener may include a groove or protuberance for receiving or seating a mating continuity bus fastener contact.

Figure 5A:
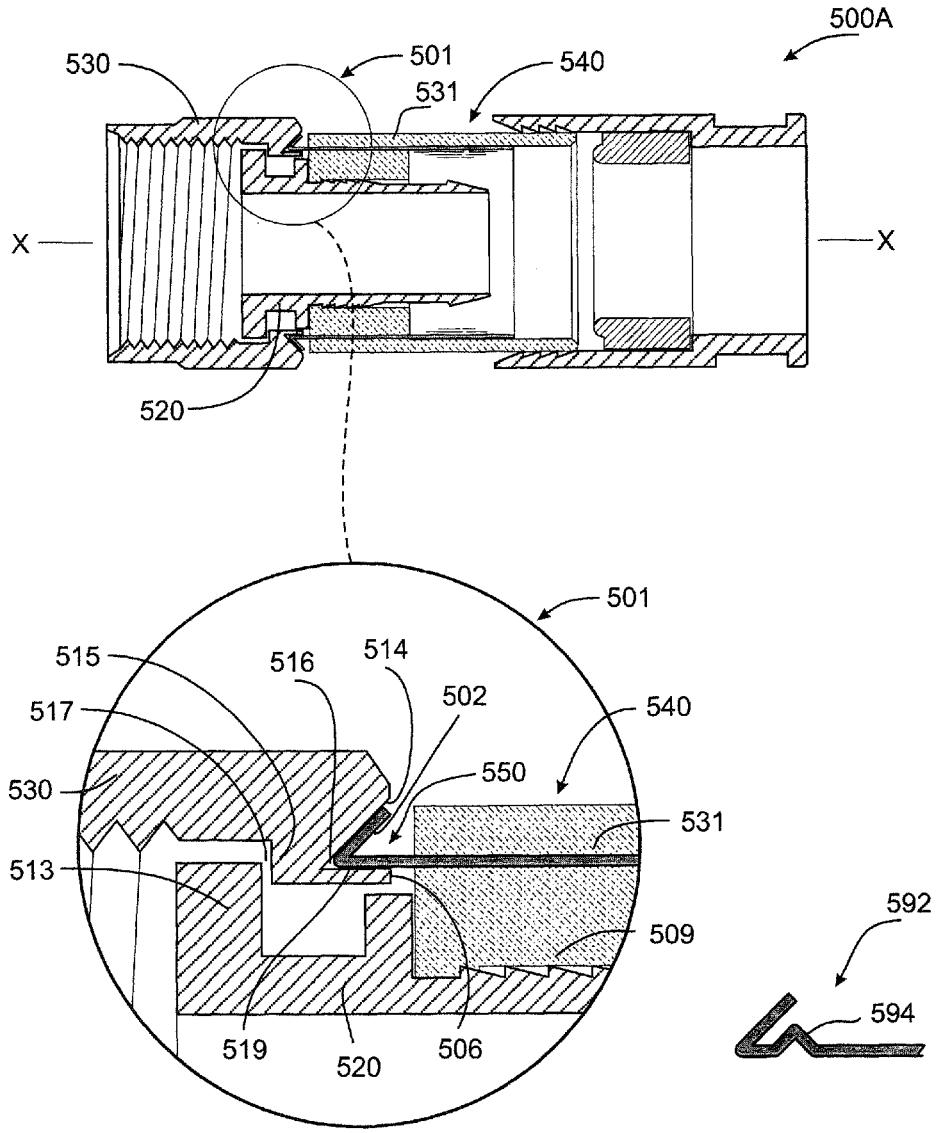
FIGS. 5A-5D and 6A-6D show cross-sectional views of continuity bus fastener contact configurations.

FIGS. 5A-D show embodiments of a continuity bus connector including fastener grooves 500A-500D. FIG. 5A shows a first continuity bus connector including a fastener groove 500A. The connector includes a post 520 and a fastener 530 adjacent to a body 540 having a body peripheral wall 531.

An enlarged connector portion 501 shows the fastener 530 to post 520 rotatable engagement and the body 540 to post attachment. In various embodiments, the fastener is coupled to the post via a post flange 513 that interengages an inwardly directed fastener rim 515. And, in various embodiments a body neck 509 surrounds and attaches to the post near the post flange.

The continuity bus 550 is located in the body wall 531 such that a continuity bus fastener contact 502 is exposed. As shown, the fastener contact is a portion of a front bus projection that is bent away from the connector centerline x-x to form a two segment arrow shaped fastener contact that is pointed into a fastener groove 516 encircling a back face 506 of the fastener (See e.g. FIGS. 4A-D). The fastener groove is generally "v" shaped and is configured to receive the arrow shaped fastener contact. In some embodiments, the fastener groove has a floor 519 about parallel to the connector centerline and a sloped ceiling 514 that is angled away from the connector centerline.

When the connector of FIG. 5A is assembled, embodiments provide for contact and/or following contact between the fastener contact and the fastener groove wall(s) 519, 514. In some embodiments, spring-like action of the fastener contact 502 maintains following contact between the fastener contact and the groove. In particular, assembly of the connector presses the fastener contact against a fastener groove wall(s), for example against the groove floor 519 and/or the groove ceiling 514. This action tends to resist formation of a gap 517 between the post flange 513 and the fastener rim 515. In various embodiments, the fastener contact acts to press the fastener rim 515 against the post flange 513 such that actions that would open the gap 517 are resisted by resilient operation of the fastener contact.

In an alternative continuity bus fastener contact and bus front projection, fastener contact travel is extended. In particular, a collapsible portion 594 is incorporated in the fastener contact and bus front projection 592.

Figure 5B:
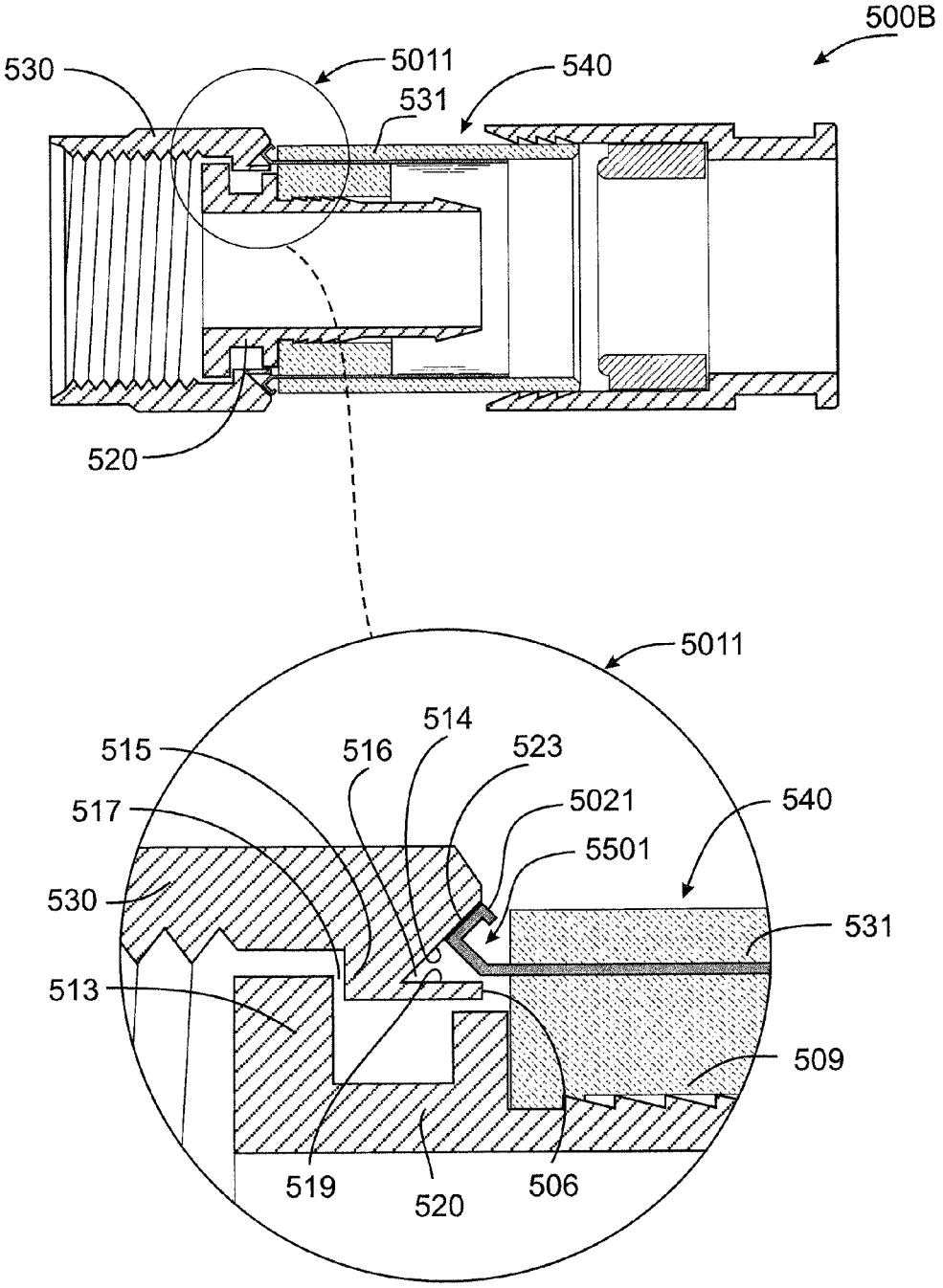

FIG. 5B shows a second continuity bus connector including a fastener groove 500B. The connector includes a post 520, a fastener 530 adjacent to a body 540 with a body peripheral wall 531, and is similar to the connector of FIG. 5A.

An enlarged connector portion 5011 shows the continuity bus of this connector 5501 is located in the body wall 531 such that a continuity bus fastener contact 5021 is exposed. As shown, the fastener contact is a portion of a front bus projection that is bent away from the connector centerline x-x to form a three segment arrow shaped fastener contact. The fastener contact is pointed into a fastener groove 516 encircling a back face 506 of the fastener (See e.g. FIGS. 4A-D). The fastener groove is generally "v" shaped and includes a floor 519 about parallel to the connector centerline and a sloped ceiling 514 that is angled away from the connector centerline.

When the connector of FIG. 5B is assembled, embodiments provide for contact and/or following contact between the fastener contact 5021 and the fastener groove 516. In particular, assembly of the connector causes contact between the fastener groove ceiling 514 and a segment 523 of the fastener contact 5021 that is parallel to the ceiling. This action tends to resist formation of a gap 517 between the post flange 513 and the fastener rim 515. In various embodiments, the fastener contact acts to press the fastener rim 515 against the post flange 513 such that actions that would open the gap 517 are resisted by resilient operation of the fastener contact.

Figure 5C:
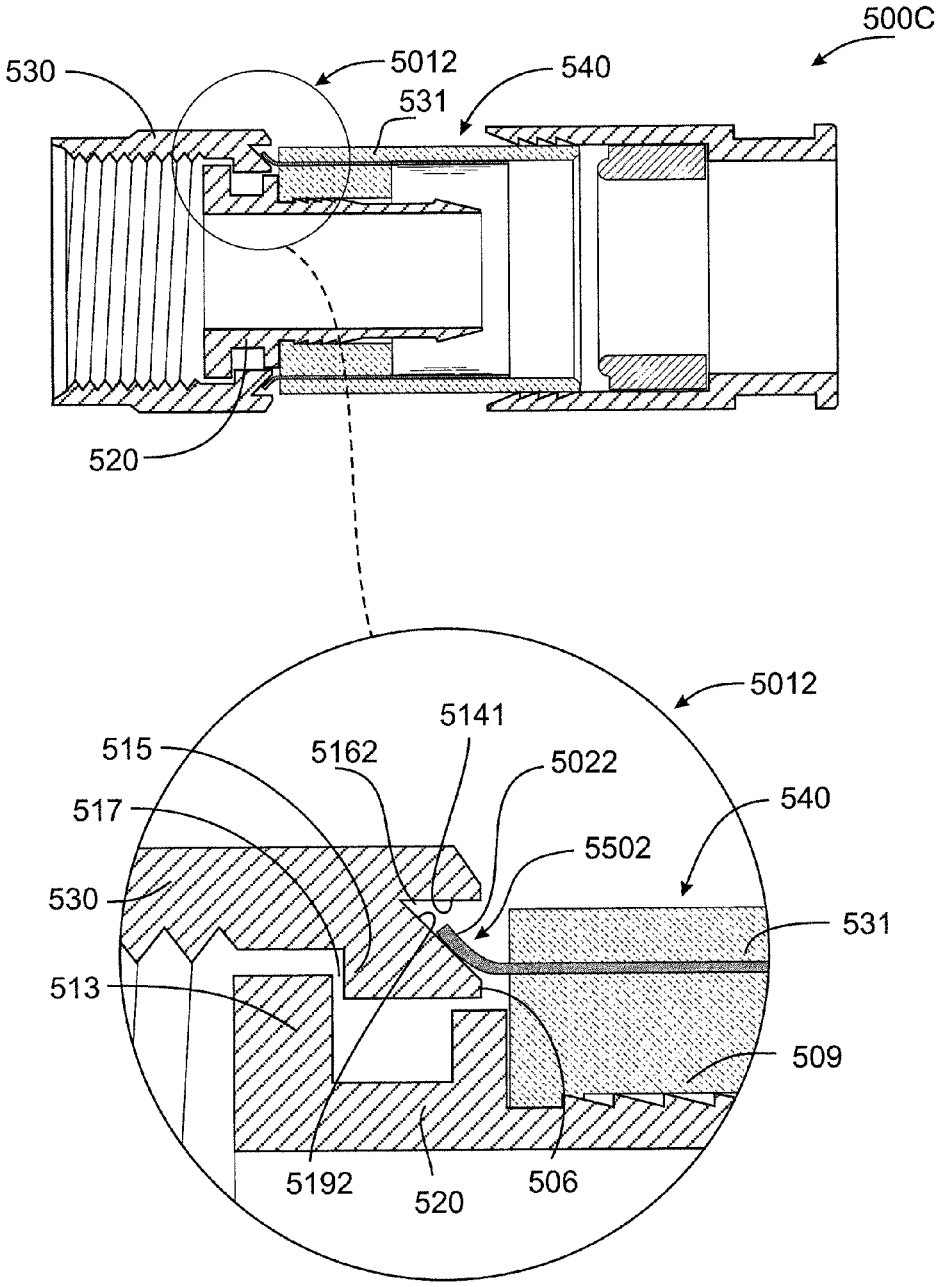

FIG. 5C shows a third continuity bus connector including a fastener groove 500C. The connector includes a post 520, a fastener 530 adjacent to a body 540 with a body peripheral wall 531, and is similar to the connector of FIG. 5A.

An enlarged connector portion 5012 shows the continuity bus of this connector 5502 is located in the body wall 531 such that a continuity bus fastener contact 5022 is exposed. As shown, the fastener contact is a portion of a front bus projection that is bent less than ninety degrees away from the connector centerline x-x to form a sloped wiper fastener contact. The fastener contact is inserted into a fastener groove 5162 encircling a back face 506 of the fastener (See e.g. FIGS. 4A-D). The fastener groove is generally "v" shaped and includes a floor 5192 sloped toward the connector centerline and a ceiling 5141 that is about parallel to the connector centerline.

When the connector of FIG. 5C is assembled, embodiments provide for contact and/or following contact between the fastener contact 5022 and the fastener groove 5162. In particular, assembly of the connector causes contact between the fastener groove floor 5192 and a fastener contact 5022. This action tends to resist formation of a gap 517 between the post flange 513 and the fastener rim 515. In various embodiments, the fastener contact acts to press the fastener rim 515 against the post flange 513 such that actions that would open the gap 517 are resisted by resilient operation of the fastener contact.

Figure 5D:
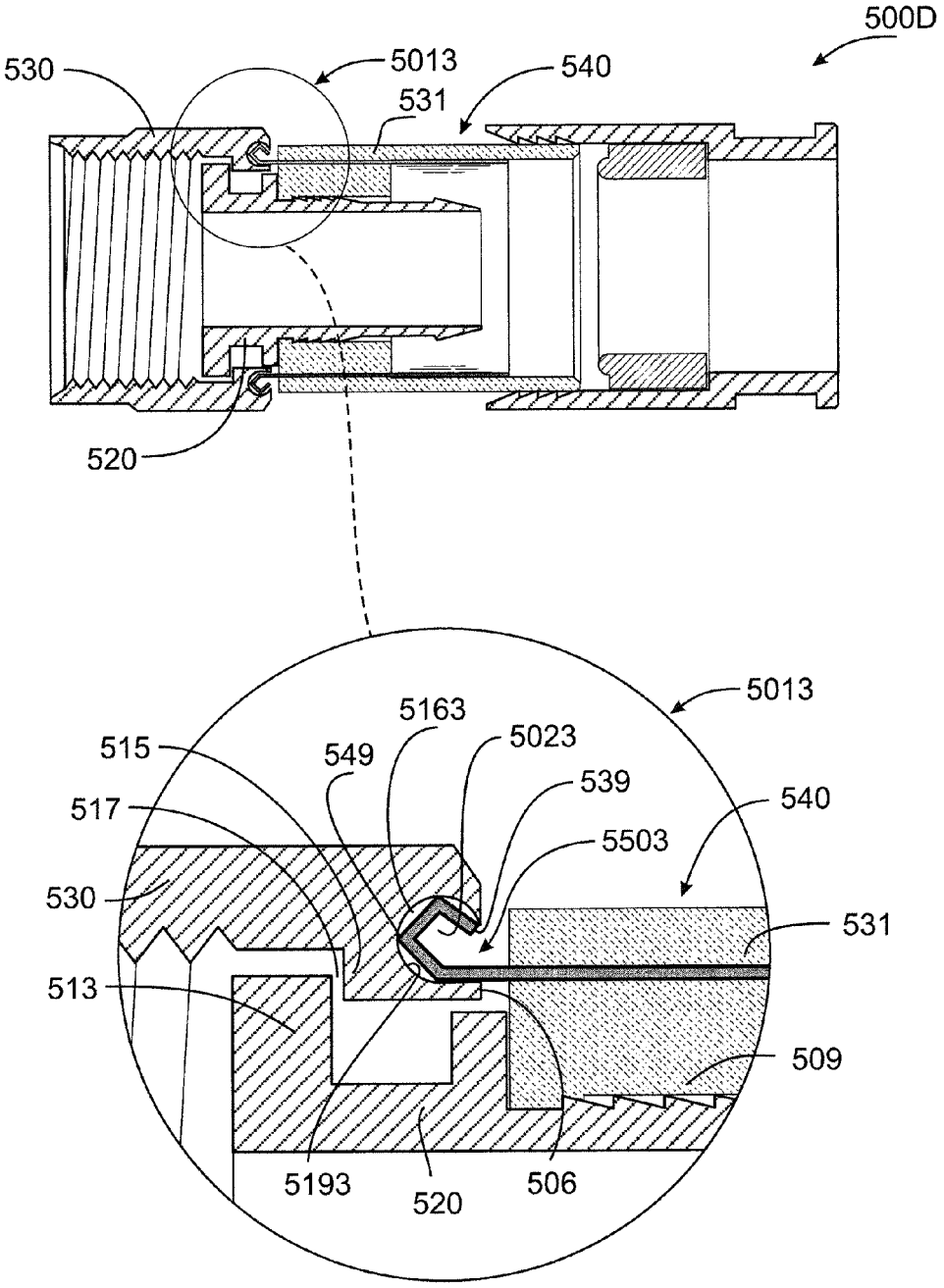

FIG. 5D shows a fourth continuity bus connector including a fastener groove 500D. The connector includes a post 520, a fastener 530 adjacent to a body 540 with a body peripheral wall 531, and is similar to the connector of FIG. 5A.

An enlarged connector portion 5013 shows the continuity bus of this connector 5503 is located in the body wall 531 such that a continuity bus fastener contact 5023 is exposed. As shown, the fastener contact is a portion of a front bus projection that is bent away from the connector centerline x-x to form a three segment arrow shaped fastener contact with three vertices (549 typical). The fastener contact is pointed into a fastener groove 5163 encircling a back face 506 of the fastener (See e.g. FIGS. 4A-D). The fastener groove is generally semi-cylindrically shaped and includes an interior groove wall 5193 defining a groove mouth 539. In various embodiments, the groove mouth is dimensioned such that the fastener contact is compressed when entering through the groove mouth and expanded after entry into the groove.

When the connector of FIG. 5D is assembled, embodiments provide for contact and/or following contact between the fastener contact 5023 and the fastener groove 5163. In particular, assembly of the connector causes contact between the fastener groove wall 5193 and vertices of the fastener contact 549 when the fastener contact is pushed through the groove mouth 539 and expands to contact the groove wall. This action tends to resist formation of a gap 517 between the post flange 513 and the fastener rim 515. In various embodiments, the fastener contact acts to press the fastener rim 515 against the post flange 513 such that actions that would open the gap 517 are resisted by resilient operation of the fastener contact.

As seen above, FIGS. 5A-D and the accompanying text describe various embodiments of the fastener and fastener contact configuration that include deformed end portions of the bus front projection (See also e.g. FIG. 4A). FIGS. 6A-6D describe embodiments of the fastener and fastener contact configuration that include coil spring end portions of the front bus projection.

Figure 6A:
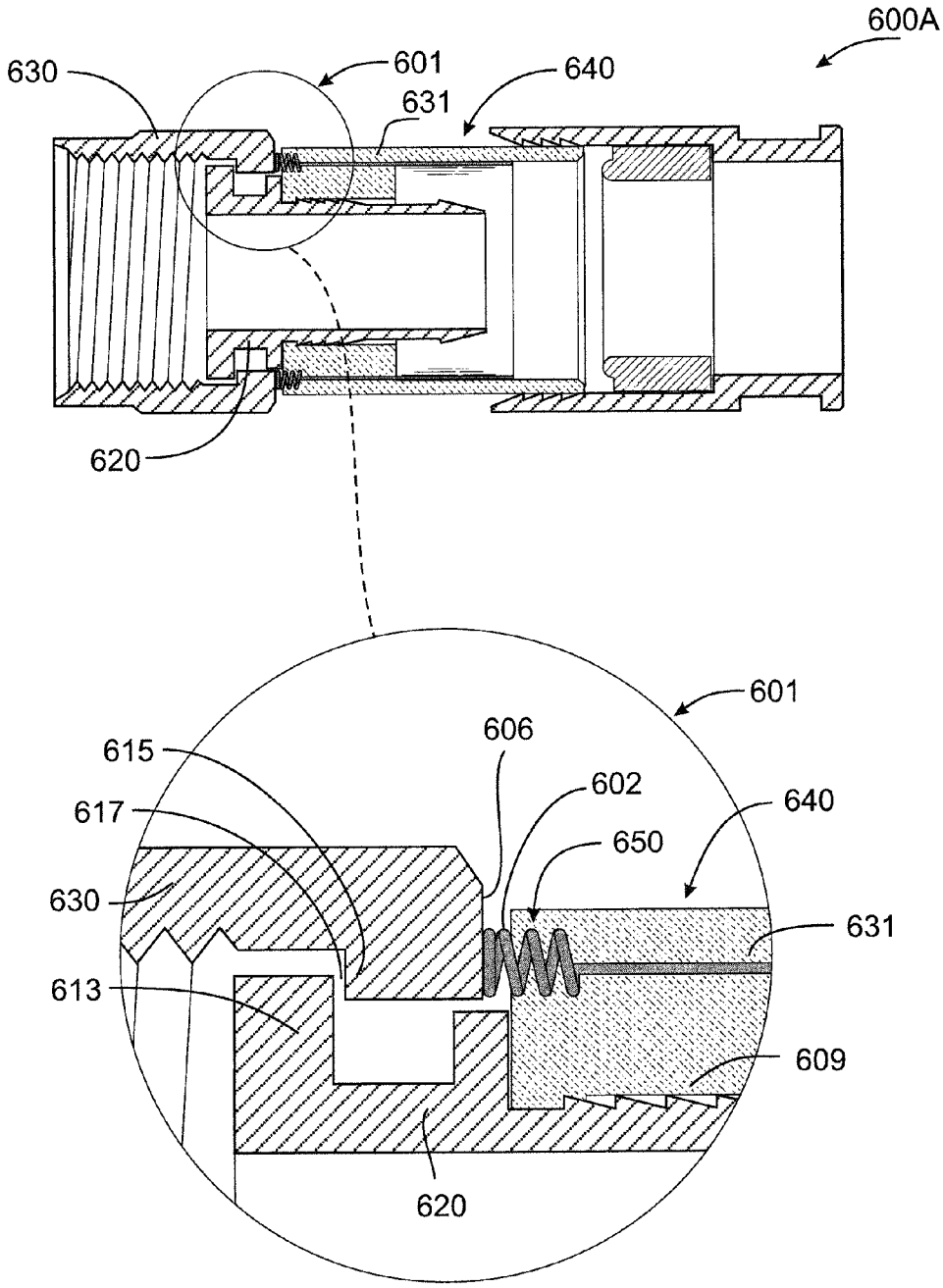

FIG. 6A shows a first continuity bus connector including a coil spring 600A. The connector includes a post 620 and a fastener 630 adjacent to a body 640 having a body peripheral wall 631.

An enlarged connector portion 601 shows the fastener 630 to post 620 rotatable engagement and the body 640 to post attachment. In various embodiments, the fastener is coupled to the post via a post flange 613 that interengages an inwardly directed fastener rim 615. And, in various embodiments a body neck 609 surrounds and attaches to the post near the post flange.

The continuity bus 650 is located in the body wall 631 such that a continuity bus fastener contact 602 is exposed. As shown, the fastener contact is made from a front bus projection that is coiled to form a coil spring.

When the connector of FIG. 6A is assembled, embodiments provide for contact and/or following contact between the coil spring fastener contact and a back face 606 of the fastener 630. In particular, assembly of the connector presses the fastener contact against a fastener back face. This action tends to resist formation of a gap 617 between the post flange 613 and the fastener rim 615. In various embodiments, the fastener contact acts to press the fastener rim 615 against the post flange 613 such that actions that would open the gap 617 are resisted by resilient operation of the fastener contact.

Figure 6B:
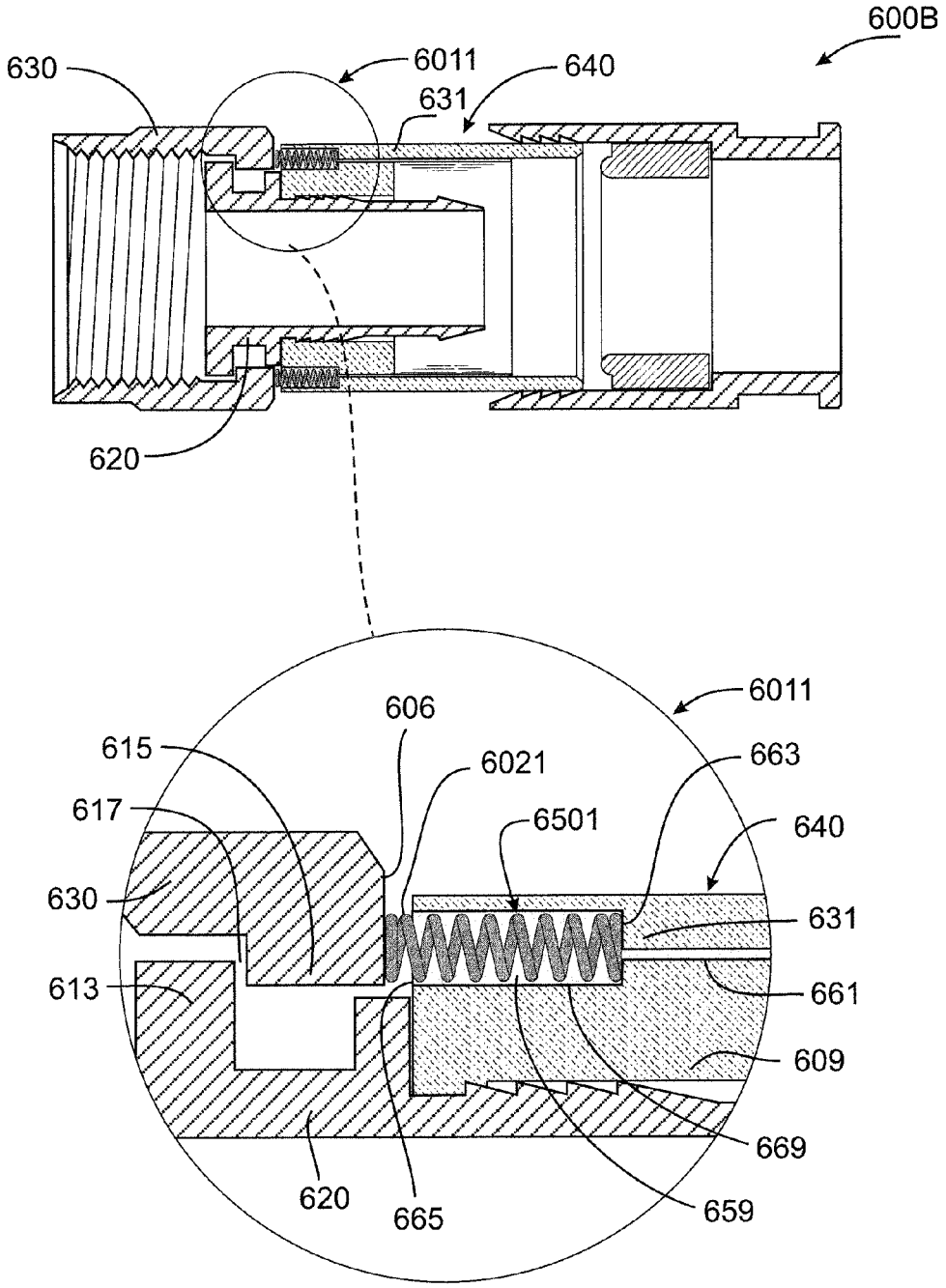

FIG. 6B shows a continuity bus connector with a coil spring 600B. The connector includes a post 620, a fastener 630 adjacent to a body 640 with a body peripheral wall 631, and is similar to the connector of FIG. 6A.

An enlarged connector portion 6011 shows a multipart continuity bus 6501 of this connector is located in the body wall 631 such that a continuity bus fastener contact 6021 is exposed. The fastener contact is in the form of a coil spring interconnected 663 (as by a disc shaped metal pusher plate or another continuity maintaining connection) with a mid-section 661 of the continuity bus.

In an embodiment (as shown), the coil spring fastener contact 6021 is inserted in a mouth 665 of a bore 659 of the body wall 631. Notably, various embodiments provide a plurality of bores with coil spring fastener contacts attached to one or more continuity bus mid sections. In some embodiments, the bore 659 is lined with a sleeve 669. And in some embodiments the sleeve is a metallic sleeve that may be interconnected with the bus mid-section 661.

When the connector of FIG. 6B is assembled, embodiments provide for contact and/or following contact between the coil spring fastener contact and a back face 606 of the fastener 630. In particular, assembly of the connector presses the fastener contact against a fastener back face. This action tends to resist formation of a gap 617 between the post flange 613 and the fastener rim 615. In various embodiments, the fastener contact acts to press the fastener rim 615 against the post flange 613 such that actions that would open the gap 617 are resisted by resilient operation of the fastener contact.

Figure 6C:
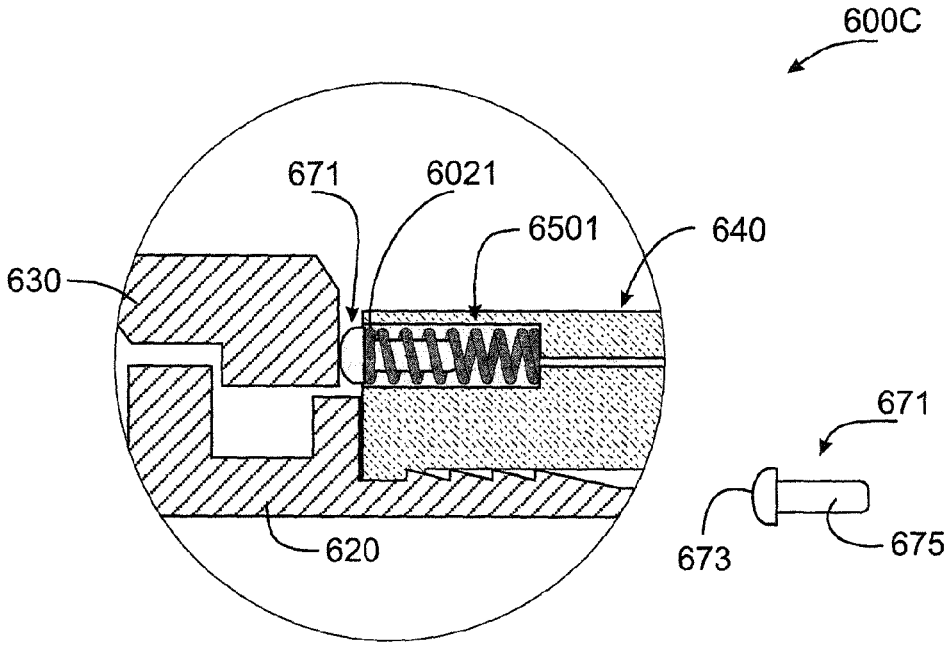

FIG. 6C shows a first alternative of the enlarged connector portion of FIG. 6B 600C. In particular, the coil spring is used to bias an electrically conductive rider or brush 671 against the fastener 630. As shown, the rider has a contacting face 673 at one end for contacting the fasteners. At another end, the rider has a shank 675 for insertion in the coil spring.

Figure 6D:
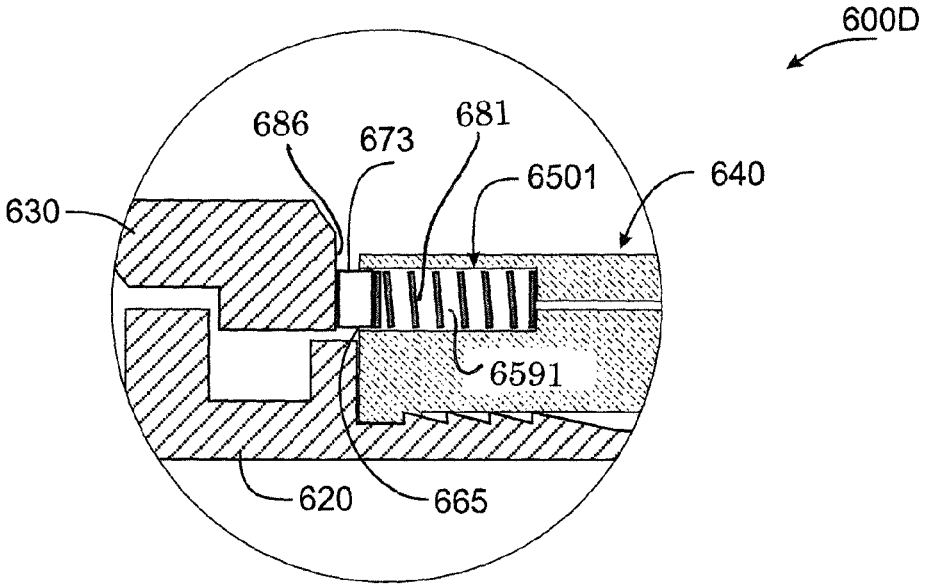

In a connector similar to the connector of FIG. 6B, the bore(s) 659 are replaced by a continuous circular groove for receiving a spring loaded ring. See for example FIG. 6D showing another coil spring connector 600D, Here, a circular groove 665 is located in a body 640 front face. The circular grove provides an annular cavity or bore 6591 for receiving a post circling coil spring 681, the spring having an outer diameter similar to a body outer diameter. In an embodiment (not shown), the spring bears on a back face of the fastener 686. In another embodiment, a ring protruding from the groove 673 is located between the spring and the fastener back face such that the ring is urged against the back face of the fastener by the spring. In various embodiments, the post circling coil spring 681 and/or the ring 673 provide a fastener contact similar in function to those discussed above. In various embodiments, the spring is integral with the remainder of the continuity bus 6501. And, in various embodiments the spring is not integral with, but is in electrical contact with, the remainder of the continuity bus 6501.

FIGS. 5A-D and FIGS. 6A-D and the accompanying text describe various embodiments of the fastener and fastener contact configuration. Just as these embodiments vary the fastener contact configuration, so to do the embodiments which follow vary the configuration of the outer conductor contact of the continuity bus. As skilled artisans will understand, these and other embodiments disclosed provide a diverse collection of "mix and match" embodiments. For example, a selected fastener and fastener contact embodiment might be matched with a selected outer conductor contact embodiment to produce a particular continuity bus variant.

Figure 7A:
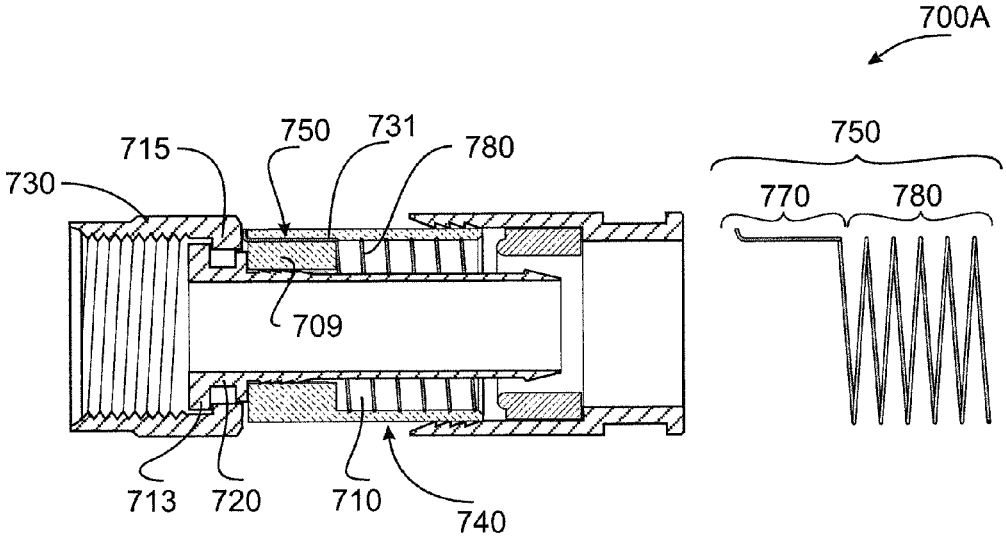
FIGS. 7A-B show cross-sectional views of continuity bus coaxial cable outer conductor contact configurations.

FIG. 7A shows a first continuity bus connector including an outer conductor coil contact 700A. The connector includes a post 720 and a fastener 730 adjacent to a body 740 having a body peripheral wall 731. In various embodiments, the fastener is coupled to the post via a post flange 713 that interengages an inwardly directed fastener rim 715. And, in various embodiments a body neck 709 surrounds and attaches to the post near the post flange.

The continuity bus 750 is located in the body wall 731 such that a continuity bus coaxial cable outer conductor contact 780 is exposed. The outer conductor contact is in the form of a coil contact inserted in an annular chamber formed between the post and the body 710.

Here, the continuity bus includes a mid-section and fastener contact 770 that adjoins the outer conductor coil. Preferred embodiments of this continuity bus 750 are made from a continuous conductor such as a conductive wire or another member suited to this application.

Figure 7B:
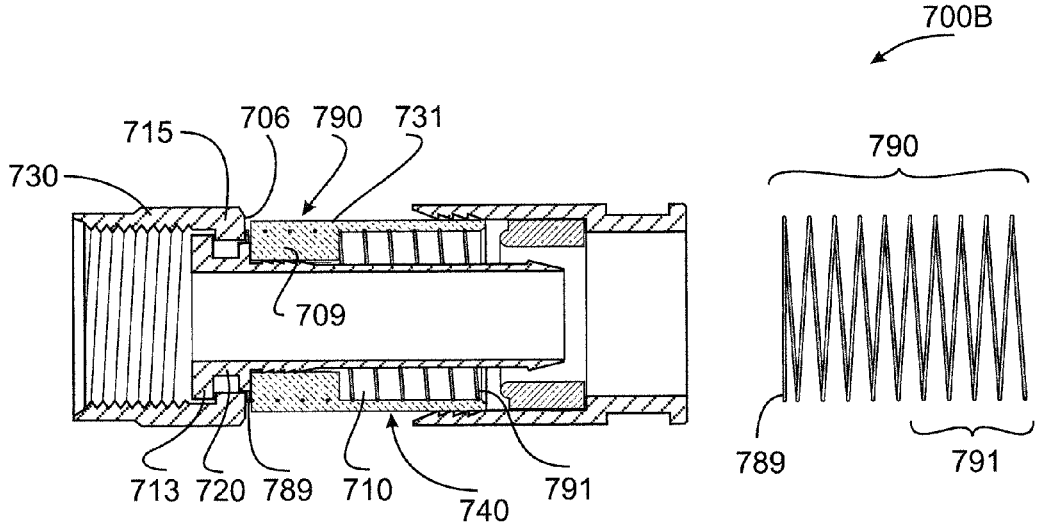

FIG. 7B shows another continuity bus connector including an outer conductor coil contact 700B. The connector includes a post 720 and a fastener 730 adjacent to a body 740 having a body peripheral wall 731 and is similar to the connector of FIG. 7A above.

The continuity bus 790 is located in the body wall 731 such that a continuity bus coaxial cable outer conductor contact 791 is exposed at one end and a fastener contact 789 is exposed at an opposed end. The outer conductor contact is in the form of a coil contact inserted in an annular chamber formed between the post and the body 710. And, the fastener contact is in the form of a coil projecting from the body and contacting a back face 706 of the fastener.

Preferred embodiments of this continuity bus 790 are made from a continuous conductor such as a conductive wire or another member suited to this application.

Yet other embodiments of the present invention utilize movable continuity busses wherein the continuity bus is pushed during insertion of a coaxial cable or during advancement of a connector rear shell.

Figure 8A:
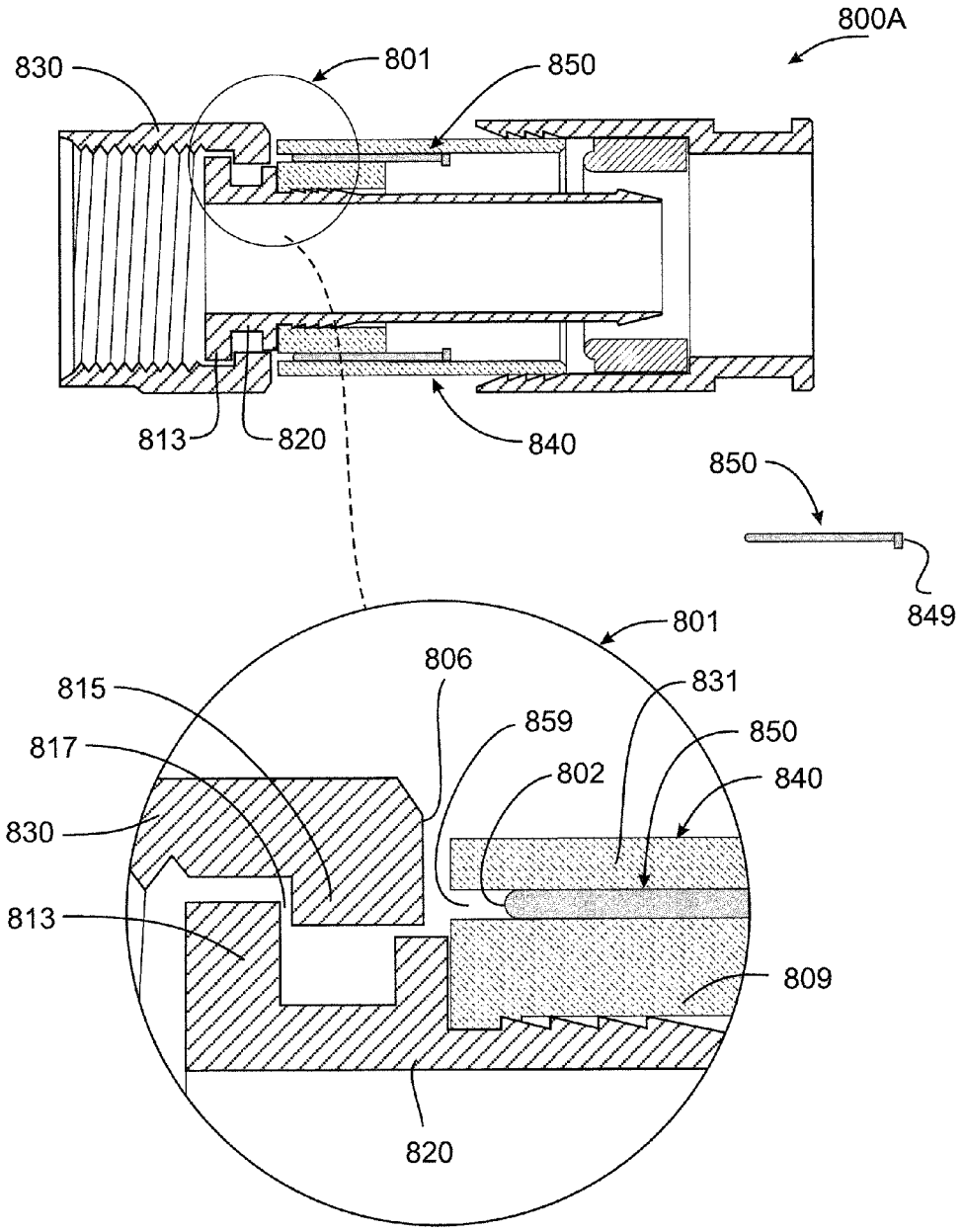
FIGS. 8A-B show cross-sectional views of coaxial cable connectors having movable continuity busses.

FIG. 8A shows a continuity bus connector including a continuity bus pushed by the coaxial cable 800A. The connector includes a post 820 and a fastener 830 adjacent to a body 840 having a body peripheral wall 831.

An enlarged connector portion 801 shows the fastener 830 to post 820 rotatable engagement and the body 840 to post attachment. In various embodiments, the fastener is coupled to the post via a post flange 813 that interengages an inwardly directed fastener rim 815. And, in various embodiments a body neck 809 surrounds and attaches to the post near the post flange.

The continuity bus 850 is located in the body wall 831 with a continuity bus fastener contact 802 is exposed at one end and a coaxial cable outer conductor contact 849 exposed at an opposed end.

While a portion of the continuity bus 850 is embedded in a void 859 in the body wall 831, the continuity bus is operable to move about parallel to the connector longitudinal axis in response to force exerted on the bus outer conductor contact 849 by the coaxial cable. Such a force pushes the continuity bus until the fastener contact 802 presses against a back face 806 of the fastener 830. As discussed above, the continuity bus is made with a suitable electrically conductive material.

When the connector of FIG. 8A is assembled and the coaxial cable is fully inserted, embodiments provide for contact and/or following contact between the fastener contact 802 and the fastener 830. In some embodiments, spring like action of the coaxial cable or the continuity bus maintains following contact between the fastener and the fastener contact. This action tends to resist formation of a gap 817 between the post flange 813 and the fastener rim 815. In various embodiments, the fastener contact acts to press the fastener rim 815 against the post flange 813 such that actions that would open the gap 817 are resisted by resilient operation of the fastener contact.

Figure 8B:
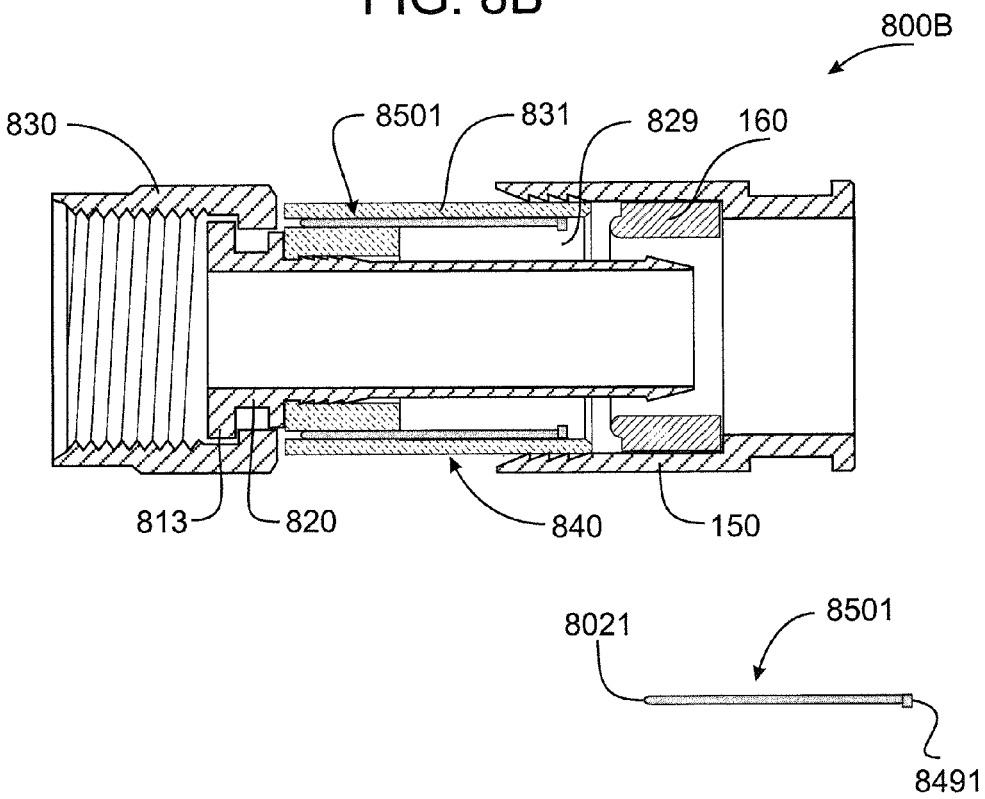

FIG. 8B shows a continuity bus connector including a continuity bus pushed indirectly by a connector end cap 800B. Similar to the connector of FIG. 8A, this connector includes a post 820 and a fastener 830 adjacent to a body 840 having a body peripheral wall 831.

A deformable ring 160 within a connector outer sleeve 150 serves to fix the cable to the connector. Fixation occurs when the sleeve is advanced onto the body, an operation forcing the ring into the annular region between the body and the post and pressing the coaxial cable jacket and outer conductor toward the post.

The continuity bus 8501 is located in the body wall 831 with a continuity bus fastener contact 8021 exposed at one end and a coaxial cable outer conductor contact 8491 exposed at an opposed end. It is noted that the length of the continuity bus is such that advancement of the rear shell and ring will cause the ring to push the continuity bus forward in a manner similar to that described in connection with FIG. 8A above.

As persons of ordinary skill in the art will appreciate, embodiments of the continuity bus of the present invention provide an electrical ground path between a coaxial cable outer conductor and an electrically conducting fastener of the connector such that the connector ground circuit tends to be maintained during events such as movement of the connector fastener relative to the connector body and failure to properly tighten the connector fastener to a female port.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A continuity bus male connector to electrically connect a cable having an inner conductor and an outer conductor with a female connector having an inner conductor and an outer conductor, the continuity bus male connector comprising:

an electrically conductive fastener;

a non-electrically conductive body;

a continuity ground bus electrically connected to the cable outer conductor and to the fastener;

the bus extending through the body from a body external surface to a body internal surface; and, the bus at least partially held in place by a cylindrical wall of the body.

2. A continuity bus male connector comprising:

a fastener having a front end and a rear end, the front end configured to mate with a female connector;

a body having a front end, a rear end, a neck, and a cavity between the front and rear ends;

a continuity around bus having a bus front projection, a bus midsection, and a bus rear section;

the bus extending through the body from a body external surface to a body internal surface; and, the bus rear section positioned in the body cavity for making electrical contact with an outer conductor of a coaxial cable when the cable is inserted into the connector.

3. The connector of claim 2 wherein:

the bus front section is positioned between the body front end and the nut rear end for electrically connecting the rear end of the nut;

the bus midsection passes through the body neck between the body cavity and the body front end; and, the continuity bus electrically connects the outer conductor of the coaxial cable to the nut.

4. A coaxial cable connector comprising:

a tubular body defining a cylindrical wall made from an insulating material;

the tubular body for receiving a prepared end of a coaxial cable with a central signal conductor spaced apart from a exposed ground conductor;

a fastener incorporating an electrical conducting material, the fastener rotatably coupled to the tubular body;

an elongated continuity ground bus having a first contact portion operable to electrically contact the exposed ground conductor and a second contact portion operable to rub the rotatable fastener;

the bus extending through the body from a body external surface to a body internal surface; and, at least a portion of the continuity bus embedded in the wall of the tubular body.

5. The coaxial cable connector of claim 4 wherein the at least a portion of the continuity bus embedded in the wall of the tubular body is slidably embedded.

6. The coaxial cable connector of claim 4 wherein electrical contact between the fastener and the continuity bus second contact portion is maintained if the fastener is moved away from the body and wherein electrical contact between the fastener and the continuity bus second contact portion is maintained if the fastener is moved toward the body.

7. A coaxial cable connector comprising:

a cylindrical insulative body;

an electrically conductive fastener rotatably coupled with the body;

a body cavity for receiving an end of a coaxial cable;

a around bus having first and second ends, the bus extending from the body cavity to the fastener; and, the bus extending through the body from a body external surface to a body internal surface; and, wherein a part of the bus that is intermediate between the bus ends is insulated by the body.

8. The coaxial cable connector of claim 7 further comprising:

a bus to fastener contact;

wherein the contact persists when the fastener is moved away from the body; and, wherein the contact persists when the fastener is moved toward the body.

9. A male F type coaxial cable connector for electrically connecting a cable having an inner conductor encircled by an outermost conductor, the connector comprising:

an electrically conductive fastener;

a non-electrically conductive body;

a continuity around bus for electrically bridging between an outermost surface of the cable outermost conductor and the fastener; and the bus extending through the body from a body external surface to a body internal surface;

wherein the continuity bus is at least partially embedded in a body wall.

10. The coaxial cable connector of claim 9 wherein the partially embedded continuity bus is movably embedded.

11. The connector of claim 9 wherein a part of the continuity bus substantially encircles the outermost conductor.

12. A male F-type coaxial connector for terminating a coaxial cable having a center conductor and a radially spaced outermost conductor:

a rotatable fastener having a front end and a rear end, the front end configured to mate with a female connector;

a body having a front end, a rear end, and a neck encircling a first cavity between the front and the rear ends;

a continuity around bus having a bus front section that projects from a body front surface, a bus midsection, and a bus rear section;

the bus extending through the body from a body external surface to a body internal surface;

the bus rear section extending into a second body cavity; and, the bus rear section for making electrical contact with an outermost coaxial cable conductor located between the bus rear section and the center conductor.

13. The connector of claim 12 wherein:

the bus front section extends from a body front end surface and contacts a nut rear end;

the bus midsection passes through the body neck between the body cavity and the body front end surface; and, the continuity bus electrically connects the outer conductor of the coaxial cable to the nut.

14. A coaxial cable connector comprising:

a conductive fastener rotatably coupled to an insulative tubular body via a central post;

a ground bus having a bus front section that extends across a peripheral gap between the fastener and the body;

the bus extending through the body from a body external surface to a body internal surface; and, the bus front section extends from an end face of the tubular body and resists gap reductions.

15. The coaxial cable connector of claim 14 further comprising a bus intermediate section encased in the tubular body.

16. The coaxial cable connector of claim 15 further comprising a bus end section enclosed in a tubular body cavity for receiving a prepared end of a coaxial cable.

17. The coaxial cable connector of claim 16 further comprising a bus front section electrical contact for rubbing against the rotatable fastener.

18. The coaxial cable connector of claim 17 wherein the bus front section is formed from a resilient metal.

19. The coaxial cable connector of claim 14 further comprising a bus rear section with a surface facing a connector central longitudinal axis wherein the surface is for contacting an exterior of the outermost conductor of the coaxial cable.

20. The coaxial cable connector of claim 19 further comprising a body neck passageway through which the bus passes.

21. The coaxial cable connector of claim 19 wherein electrical continuity along a connector ground path is improved by operation of the bus.

* * * * *